US008915000B2

(12) United States Patent
Pochatek et al.

(10) Patent No.: US 8,915,000 B2
(45) Date of Patent: Dec. 23, 2014

(54) GREETING CARDS WITH OPTICAL FIBERS

(71) Applicant: American Greetings Corporation, Cleveland, OH (US)

(72) Inventors: Cindi Pochatek, Minneapolis, MN (US); Lynne Shlonsky, Shaker Heights, OH (US); Erin Dennis, Lakewood, OH (US)

(73) Assignee: American Greetings Corporation, Cleveland, OH (US)

( * ) Notice: Subject to any disclaimer, the term of this patent is extended or adjusted under 35 U.S.C. 154(b) by 1 day.

(21) Appl. No.: 13/800,936

(22) Filed: Mar. 13, 2013

(65) Prior Publication Data

US 2013/0305572 A1 Nov. 21, 2013

Related U.S. Application Data

(60) Provisional application No. 61/647,065, filed on May 15, 2012.

(51) Int. Cl.
*G09F 13/00* (2006.01)
*B42D 15/02* (2006.01)

(52) U.S. Cl.
CPC ..... *B42D 15/022* (2013.01)
USPC ..... 40/539; 362/568; 40/547

(58) Field of Classification Search
CPC .... A47G 1/0622; B42D 15/022; G02B 6/008; G02B 9/305; G02B 6/006; G02B 6/001
USPC ..... 40/547, 124.02; 362/559
See application file for complete search history.

(56) References Cited

U.S. PATENT DOCUMENTS

| | | | | |
|---|---|---|---|---|
| 4,363,081 | A * | 12/1982 | Wilbur | 362/98 |
| 4,559,583 | A * | 12/1985 | Ku | 362/565 |
| 5,217,286 | A * | 6/1993 | Ming-ho | 362/612 |
| 5,460,414 | A * | 10/1995 | Sargis | 281/38 |
| 5,782,023 | A | 7/1998 | Iannantuano et al. | |
| 5,944,416 | A * | 8/1999 | Marsh | 362/568 |
| 6,865,831 | B2 | 3/2005 | Launey | |
| 6,908,206 | B1 | 6/2005 | Pinciaro | |
| 7,988,525 | B2 | 8/2011 | Garbos et al. | |
| 8,661,719 | B2 * | 3/2014 | Hughes et al. | 40/124.04 |
| 2011/0088292 | A1 | 4/2011 | Kay et al. | |
| 2011/0261581 | A1 | 10/2011 | Garbos et al. | |

FOREIGN PATENT DOCUMENTS

EP 514881 A1 * 11/1992

* cited by examiner

*Primary Examiner* — Casandra Davis
(74) *Attorney, Agent, or Firm* — Christine Flanagan

(57) ABSTRACT

The greeting card of the present invention includes a three-panel pocket with an internal cavity which contains a fiber optic bundle, various electronic components, fabric layer and a removable panel. A front face of the three-panel pocket contains a substantial opening thereon through which the fabric layer is visible. The fiber optic bundle contains various fiber optic strands. Each of the fiber optic strands is inserted through the fabric layer and is visible through the front face of the greeting card. A contact arm switch controls illumination of the fiber optic strands along with the insertion and removal of the removable panel.

20 Claims, 8 Drawing Sheets

GREETING CARDS WITH OPTICAL FIBERS

RELATED APPLICATIONS

This application claims priority to U.S. Provisional Patent Application No. 61/647,065, filed on May 15, 2012, a copy of which is incorporated herein by reference in its entirety.

FIELD OF THE INVENTION

The present invention is in the field of greeting cards and more specifically to greeting cards having sound capability and fiber optic light.

SUMMARY OF THE INVENTION

The greeting card of the present invention includes a three-panel pocket with an internal cavity which contains a fiber optic bundle, various electronic components, fabric layer and a removable panel. A front face of the three-panel pocket contains a substantial opening thereon through which the fabric layer is visible. The fiber optic bundle contains various fiber optic strands. Each of the fiber optic strands is inserted through the fabric layer and is visible through the front face of the greeting card. A contact arm switch controls illumination of the fiber optic strands along with the insertion and removal of the removable panel.

DETAILED DESCRIPTION OF PREFERRED AND ALTERNATE EMBODIMENTS

Figure 1:
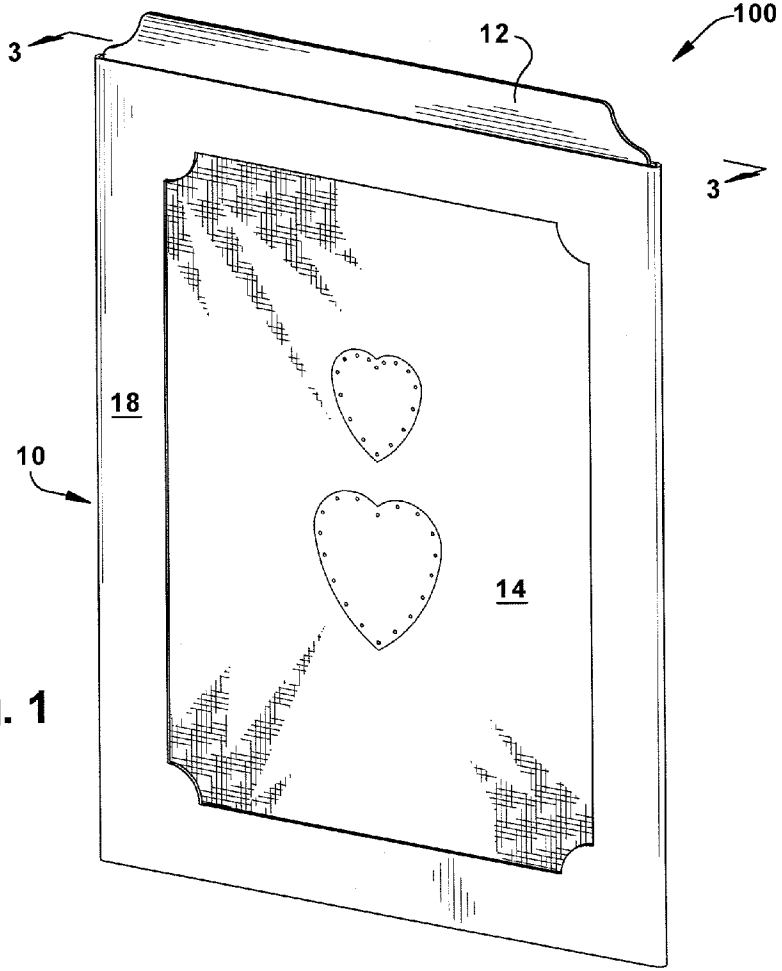
FIG. 1 is a perspective view of a first embodiment of the greeting card of the present invention.
Figure 2:
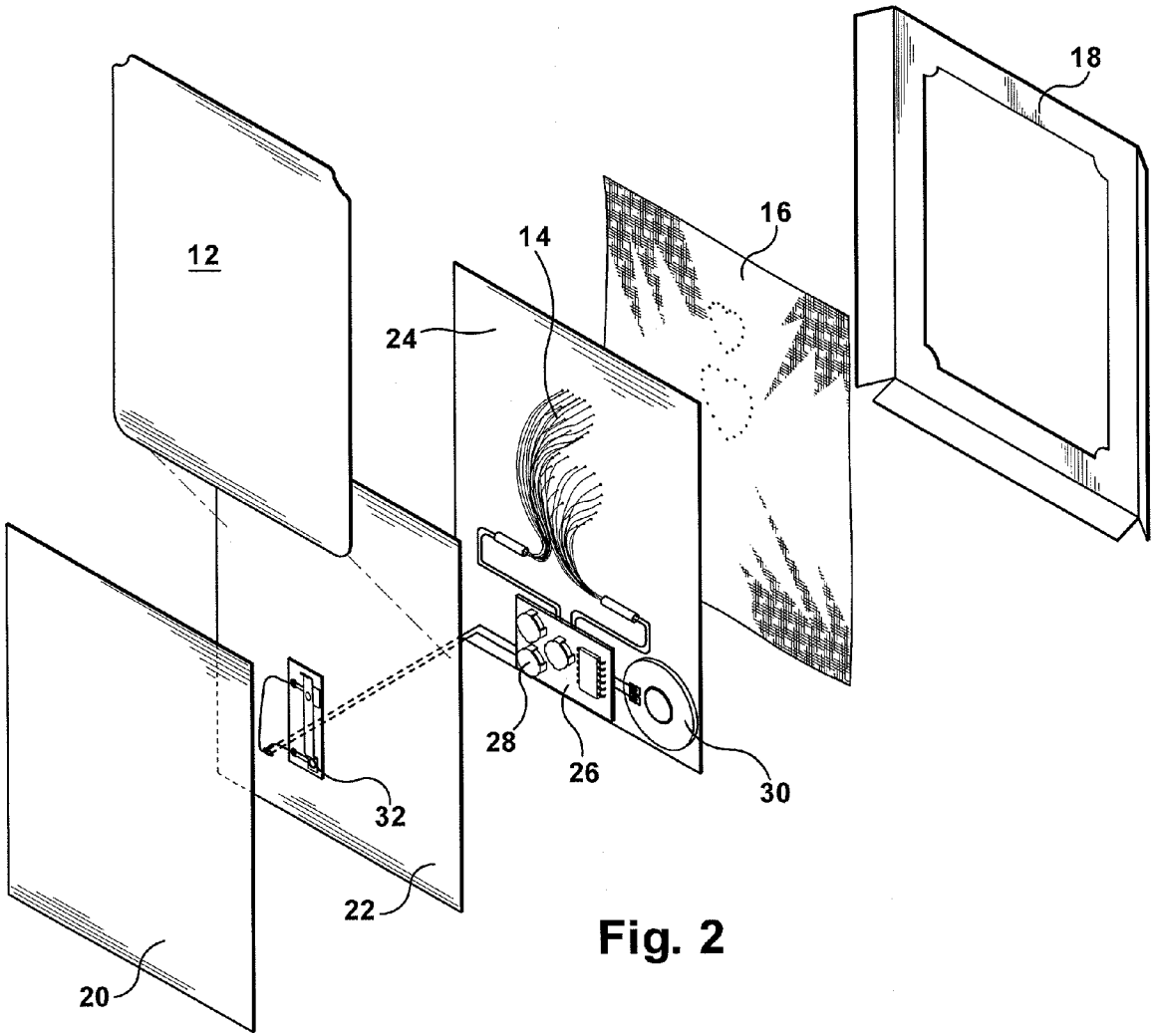
FIG. 2 is an exploded view of the greeting card of FIG. 1.
Figure 4:
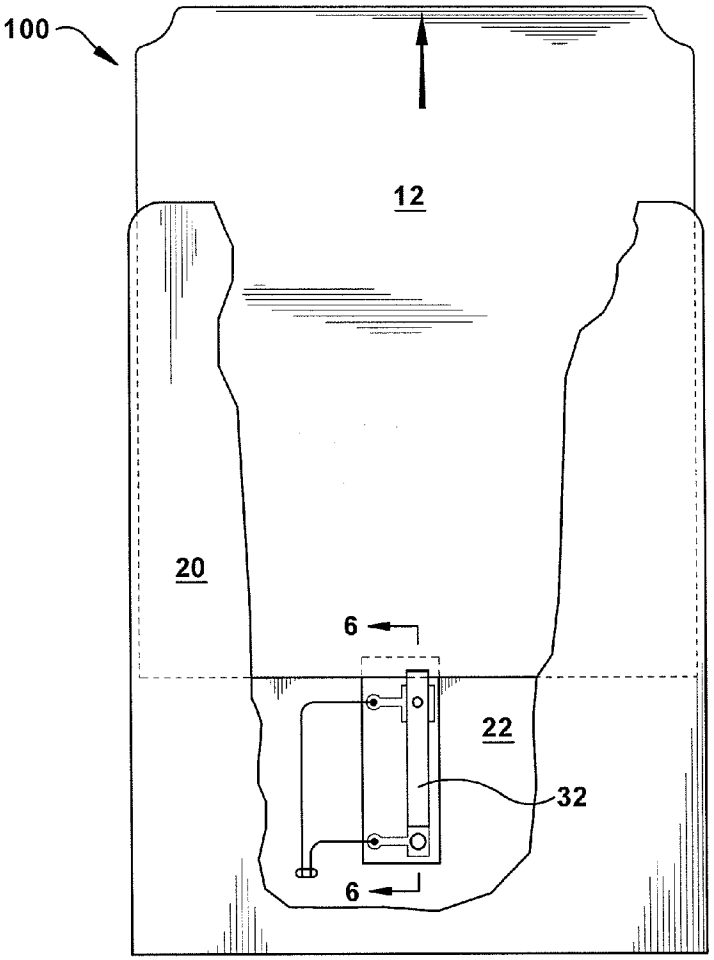
FIG. 4 is a rear tear-away view of the greeting card of FIG. 1 with the removable panel in a second position.
Figure 3:
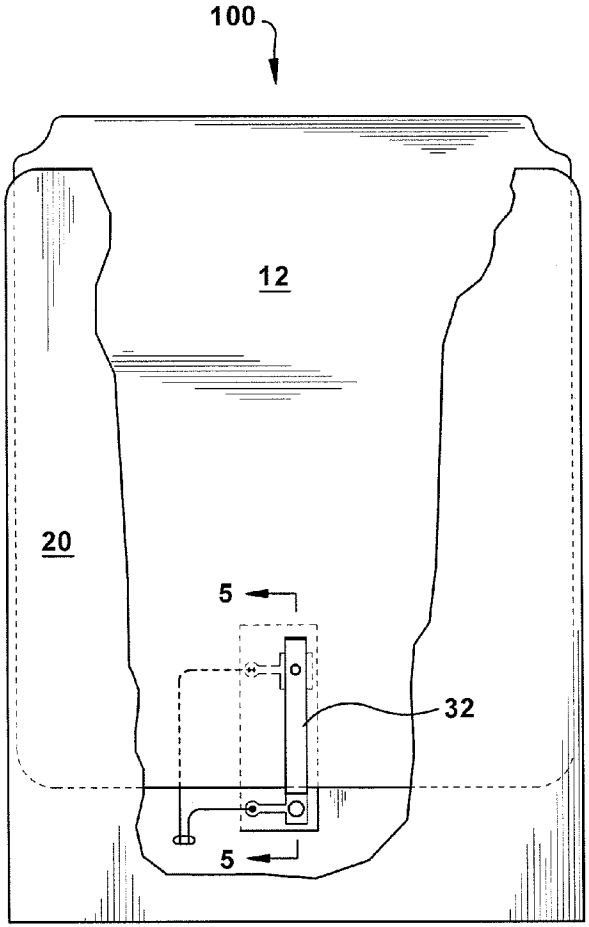
FIG. 3 is a rear tear-away view of the greeting card of FIG. 1 with the removable panel in a first position.
Figure 6:
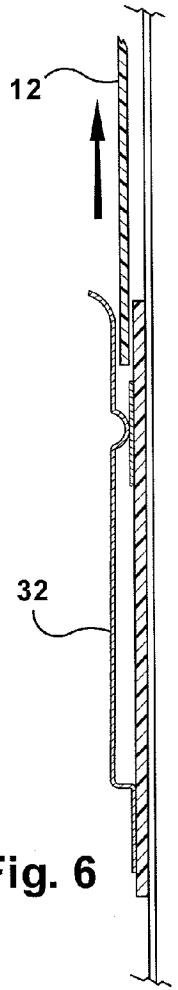
FIG. 6 is a side view of the greeting card of FIG. 4 from the perspective of arrows 6-6.
Figure 5:
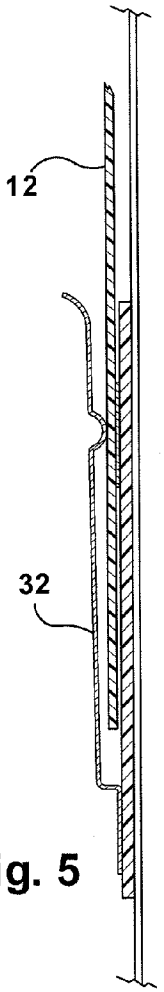
FIG. 5 is a side view of the greeting card of FIG. 3 from the perspective of arrows 5-5.

The greeting card of the present disclosure and related inventions combines a paper greeting card with fabric and fiber optics to create a visually stimulating greeting card.

In a first embodiment 100, shown in FIGS. 1 through 6, two or more greeting card panels are combined to form a three sided pocket or cavity having an opening along a top edge of the pocket for insertion of a removable panel 12. The removable panel 12, in a first position (shown in FIG. 1), is substantially contained within the greeting card pocket 10, with a portion of the panel 12 visible, extending up through the top open edge of the pocket 10. In a second position (shown in FIG. 4), the removable panel 12 is completely removed from the pocket 10. Removal of the removable panel 12 causes one or more fiber optic strands 14, which are visible through the front of the greeting card pocket 10 to turn on or light up. As an example, the greeting card 100 may contain three greeting card panels which are attached along two fold lines. Each panel is of a substantially rectangular shape and all panels have approximately the same length and width, although in other embodiments, the panels may be of a different shape and may have varying length and/or width measurements. Each panel has a front surface and a back surface opposite the front surface. A first panel 22 is attached to a second panel 18 along a first horizontal fold line and the second panel 18 is attached to a third panel 20 along a second horizontal fold line. The second panel 18 contains a substantial opening thereon around which is a border or frame. The second panel 18 may also have two tab panels, a first tab panel attached to a right side long edge of the second panel 18 and a second tab panel attached to a left side long edge of the second panel 18. A layer of fabric 16 is placed over the back surface of the second panel 18 such that the fabric 16 can be seen through the opening on the second panel 18. The fabric 16 is a thin piece of material which may contain various designs or patterns printed thereon. While referred to herein as "fabric" the material may be any type of woven, non-woven material. A fourth panel 24 or sheet material may be placed behind the fabric layer 16 such that the fabric layer 16 is sandwiched between the second panel 18 and the fourth panel 24.

A fiber optic bundle 14 comprising one or more fiber optic strands connected to one or more LED light bulbs is located behind the fourth panel 24 opposite the fabric layer 16. The one or more fiber optic strands 14 are inserted through the fourth panel 24 and the fabric layer 16 such that the fiber optics are visible through the fabric 16 from the opening in the second panel 18 of the greeting card 100. The fiber optic bundle 14 may be taped or otherwise secured behind the fourth panel 24. Also attached are various electronic components such as, but not limited to, a circuit board 26, integrated circuit, power source (one or more batteries) 28, a speaker 30, a switch 32 and any other component which facilitates illumination of the fiber optics upon some triggering event. Once the fiber optic bundle 14 and electronic components are secured behind the second 18 and fourth panels 24 and the layer of fabric 16, the first panel 22, which is connected to the second panel 18 along a top horizontal edge, is folded downward along the first fold line such that it covers the fourth panel 24 and the fourth panel 24 and fabric layer 16 are positioned between the second 18 and first panels 22. The first and second tab panels on the second panel 18 are folded over the first panel 22 to secure the fabric 16 and fiber optic strand 14 therebetween. Finally, the third panel 20, which is connected to the second panel 18 along a second fold line along a bottom horizontal short edge of the second panel 18 is folded upward along the second fold line and attached, adhesively or otherwise, to the first and second tab panels of the second panel 18 so that the second panel 18 (which is the front of the greeting card) and the third panel 20 (which is the back of the greeting card) form a three sided pocket or cavity with an opening along the top short edge of the greeting card 100.

In a preferred embodiment, the switch mechanism 32 is a contact switch. The contact switch 32 may contain two contact arms that when in contact complete an electrical circuit. Separating the contact arms breaks the circuit. A removable panel 12 is inserted into the greeting card 100 through the open top edge of the cavity, and gets inserted between the two arms of the contact switch 32 (shown in FIG. 5), thereby interrupting the circuit. The removable panel 12 may be a single panel or may have to or more panels, such as a twopaneled greeting card. Removal of the removable panel 12 from the greeting card pocket or cavity removes the barrier between the two contact arms such that they are again in direct contact with each other (shown in FIG. 6), thereby completing the circuit and providing power to illuminate the one or more fiber optic strands visible through the fabric layer 16. Re-inserting of the removable panel 12 into the pocket or cavity and between the two arms of the contact switch 32 prevents power to the fiber optics 14 and extinguishes the light. The fiber optics 14 may be programmed to blink, twinkle, or perform any other special light effects. The arms of the contact switch 32 may be of any length, however, a longer length is preferred over a shorter length, to ensure proper placement of the removable panel 12 between the two arms of the switch 32 as it is inserted into the pocket or cavity of the greeting card 100. The removable panel 12 may contain an opening thereon proximate to a top edge of the panel 12, through which a ribbon or cord or other attachment device may be inserted. The ribbon or cord may be used by the greeting card recipient to remove the removable panel 12 from the greeting card pocket.

Figure 7:
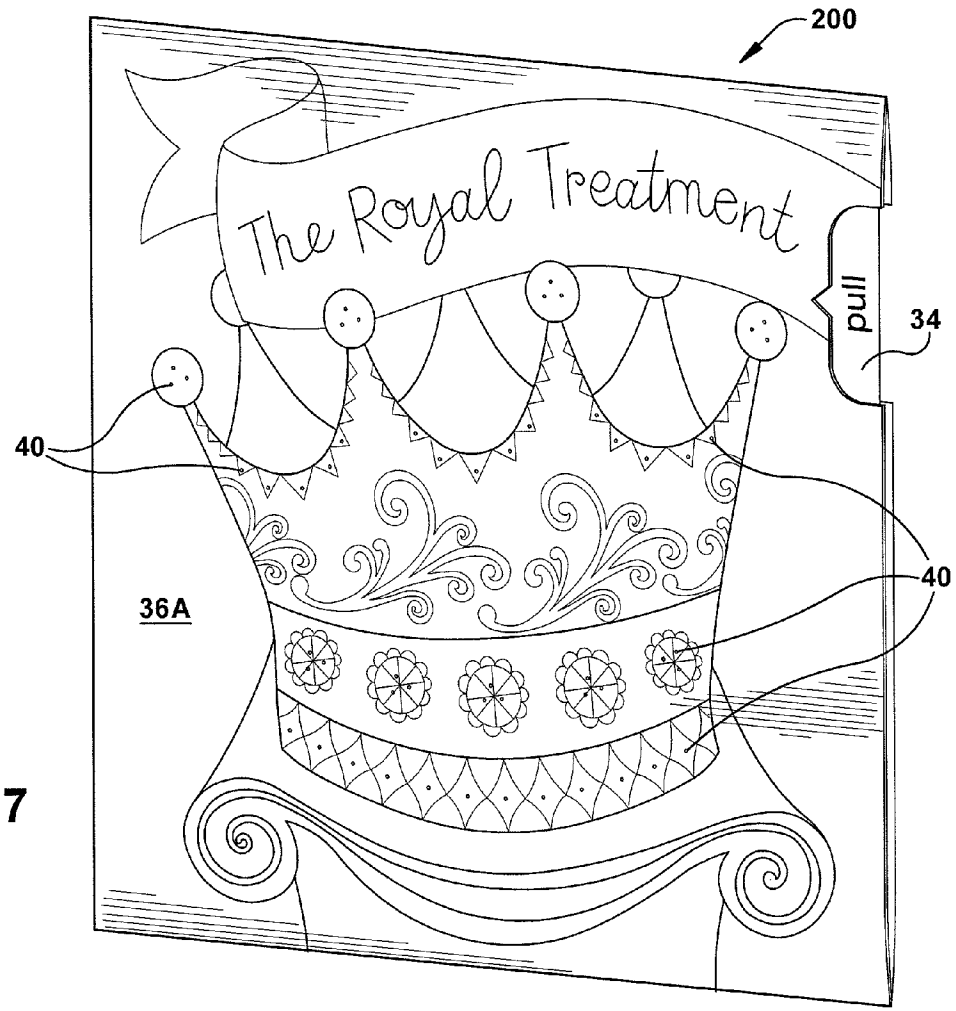
FIG. 7 is a perspective view of a second embodiment of the greeting card of the present invention, with the removable panel in a first position.
Figure 8:
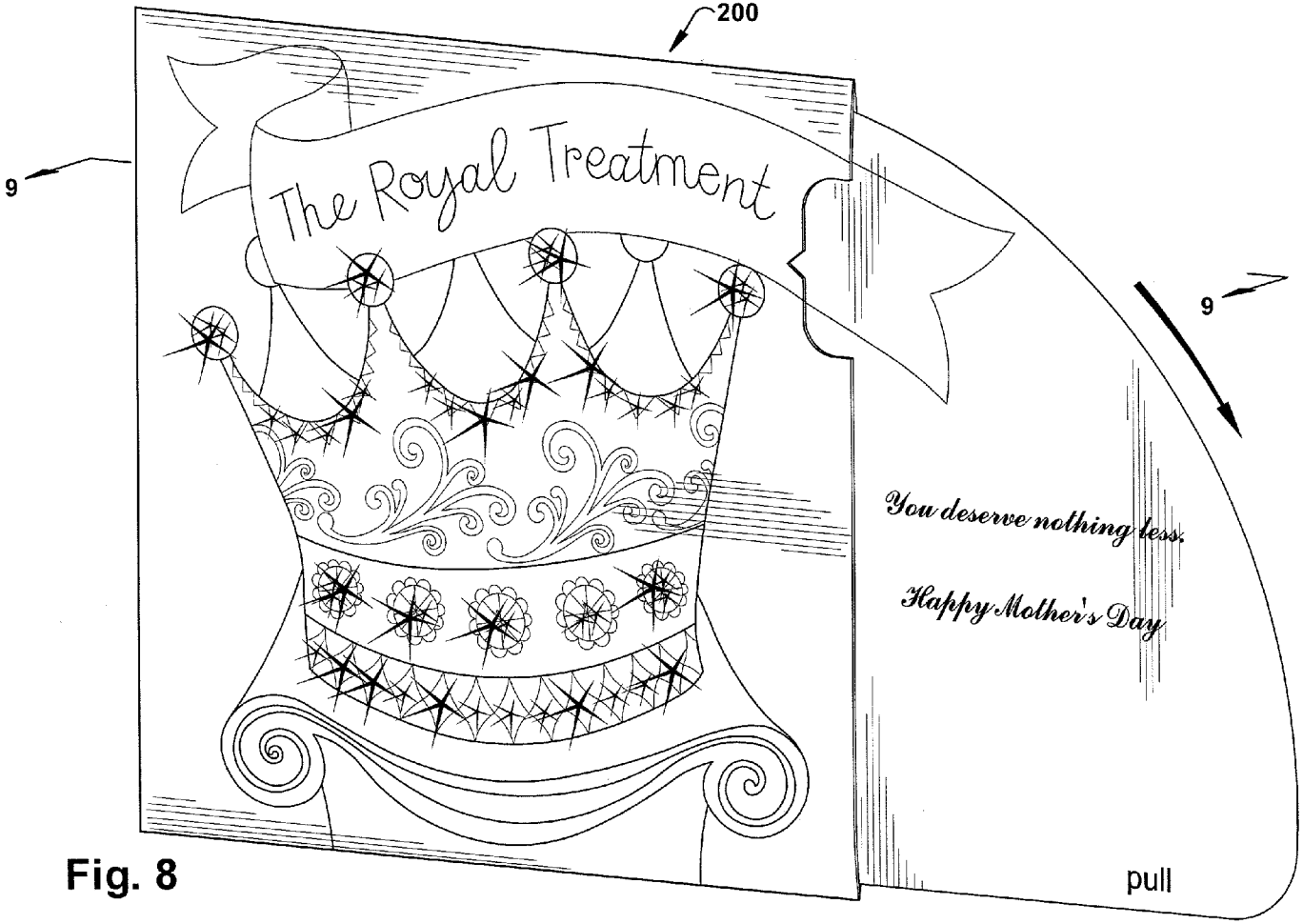
FIG. 8 is a perspective view of the greeting card of FIG. 7 with the removable panel in a second position.
Figure 9:
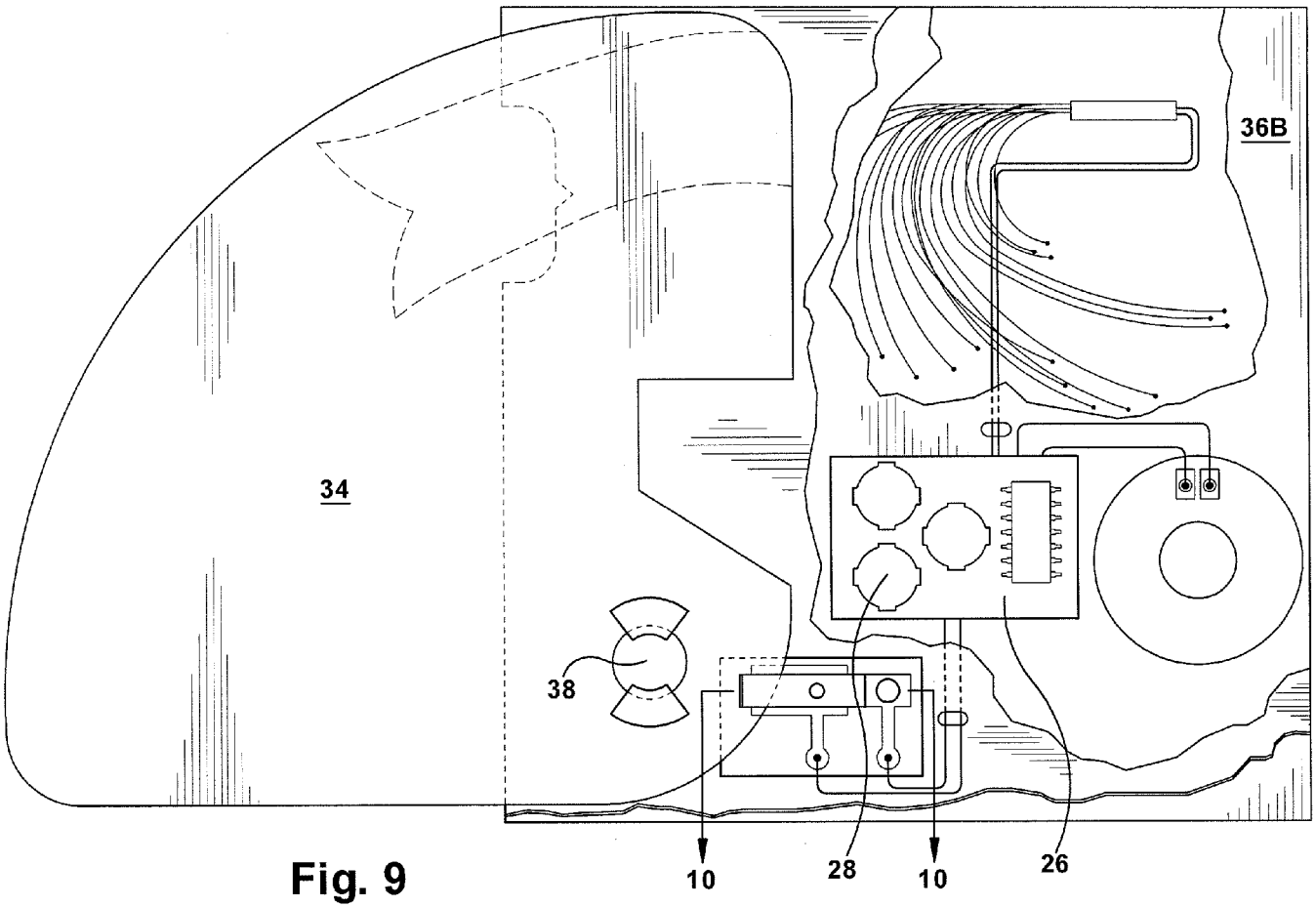
FIG. 9 is a rear tear-away view of the greeting card of FIG. 8.
Figure 10:
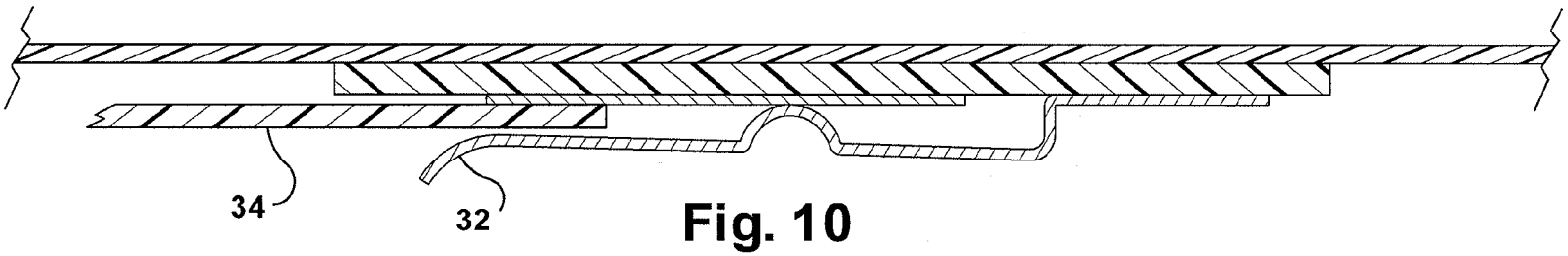
FIG. 10 is a side view of the greeting card of FIG. 9 from the perspective of arrows 10-10.
Figure 11:
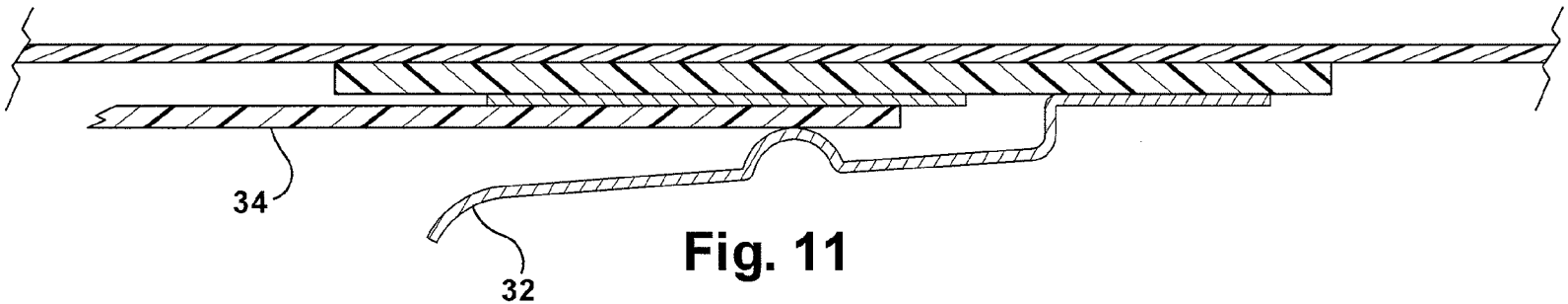
FIG. 11 is a side view of the greeting card of FIG. 7.

In a second embodiment 200, shown in FIGS. 7 through 11, the greeting card has at least two four-sided greeting card panels 36A, 36B which are attached along three outer perimeter edges, creating an open-ended cavity therebetween. While the open perimeter edge may be along any of the four perimeter edges, in a preferred embodiment, the open edge is the right vertical edge. A sound and light module are contained within the open ended cavity. The sound and light modules may be secured to one or both the panels 36A, 36B to ensure that they stay in place inside the cavity and cannot be removed from the open edge. As described above, the sound and light modules may contain a variety of electronic components which may include, but are not limited to: a circuit board 26, integrated circuit, a memory storage device, power source 28 (one or more batteries), one or more fiber optic strands 14, a speaker 30 and any other component which facilitates illumination of fiber optics 14 and/or playback of at least one digital audio recording upon some triggering event. A sliding panel 34 is contained between the at least two four-sided greeting card panels 36A, 36B, the sliding panel 34 being attached to the greeting card (between the two panels 36A, 36B) at a pivot point 38, wherein the sliding panel 34 can be pivoted about the pivot point 38 from a first position, wherein the sliding panel 34 is substantially contained within the greeting card cavity (shown in FIG. 7) and a second position, wherein the sliding panel 34 is rotated about the pivot point 38 to be substantially outside of the greeting card cavity (shown in FIGS. 8 and 9). A slide or contact arm switch (described above) is contained within the greeting card cavity and works in combination with the sliding panel 34 to control illumination of the fiber optics 14 and/or playback of at least one digital audio file stored on the sound module. The front and back panels 36A, 36B of the greeting card cavity may contain notched areas wherein a portion of the panel is removed. These notched portions serve to make the inner sliding panel 34 visible from the outside of the greeting card, as shown in FIG. 7. The sliding panel 34 may contain printing thereon containing the word "pull" to direct the user to pull the sliding panel 34 outside of the greeting card cavity and initiate the special effects such as lighting and/or sound. The front greeting card panel 36A contains one or more openings or apertures 40 thereon through which the fiber optics 14 are visible. A fiber optic bundle 14, as described above with regard to the first embodiment 100, is contained in the greeting card cavity and may be taped therein such that the end portion of the fiber optic strands 14 are aligned with the openings 40 on the front greeting card panel 36A. Moving the inside sliding panel 34 from within the cavity (shown in FIG. 11) to outside the cavity (shown in FIG. 10), triggers the switch which causes illumination of the fiber optics 14 and/or playback of pre-recorded audio. The pre-recorded audio may contain music, a song, spoken word, or any other audible sounds. While this greeting card has been described as having two panels connected along three edges to form an open ended cavity, another panel may be inserted therein upon which the electronic components and/or fiber optic strands may be attached.

While the greeting cards of the present invention have been described herein as having a substantially rectangular or four sided shape, other greeting card panel shapes have been contemplated. Also, the various panels of the greeting card pocket or cavities are connected along various fold lines and folded in a particular manner described herein, however, any number of panels may be arranged in a variety of ways to contain and conceal the various electronic components and fiber optic bundle and to display the fabric layer with fiber optic strands extending therethrough. Also, other electronic components may be added to the present invention to provide further entertainment for the greeting card recipient, such as sound or music capabilities, recording capabilities, and other special effects. A contact switch is described herein to control power to the fiber optic strands, however, any other type of switch may be used, such as a slide switch, magnetic switch, light sensitive switch, touch sensitive switch or capacitance switch, or any other such switches which are known to one of skill in the art. The embodiment described herein was intended as an example only and is not meant to limit the invention in any way.

What is claimed is:

1. A greeting card comprising:

two or more connected greeting card panels which form a pocket having one open end;

one of the two or more greeting card panels serving as a front cover of the greeting card and having a substantial aperture contained thereon;

a fabric-covered panel that is contained within the pocket and visible through the aperture in the front cover of the greeting card;

a removable panel which can be inserted and removed from the pocket through the open end;

a fiber optic bundle containing a plurality of fiber optic strands, the fiber optic bundle contained within the pocket, the fiber optic strands inserted through the fabric-covered panel and visible through the aperture in the front facing greeting card;

a switch contained within the pocket which controls illumination of the fiber optic strands;

a power source which provides power to the fiber optic bundle via operation of the switch.

2. The greeting card of claim 1, wherein when the removable panel is contained in the pocket, a top edge of the removable panel remains outside of the pocket.

3. The greeting card of claim 2, wherein the removable panel contains an opening thereon proximate to the top edge of the removable panel, a ribbon being inserted through the opening and tied.

4. The greeting card of claim 1, wherein the removable panel is not permanently attached to pocket.

5. The greeting card of claim 1, wherein the removable panel interacts with the switch to control illumination of the fiber optic strands.

6. The greeting card of claim 1, wherein removing the removable panel from the three-sided pocket activates the switch thereby illuminating the fiber optic strands.

7. The greeting card of claim 1, wherein inserting the removable panel into the three-sided pocket deactivates the switch, thereby causing the fiber optic strands to turn off.

8. A greeting card comprising:

at least two greeting card panels which are attached to form an open-sided cavity, one of the at least two greeting card panels having one or more apertures contained thereon;

a slide panel which is attached to one of the at least two greeting card panels at a pivot point, the slide panel operative to move between a first position wherein the slide panel is substantially contained within the open-sided cavity and a second position wherein the slide panel is substantially outside of the open-sided cavity;

a fiber optic bundle comprised of a plurality of fiber optic strands, one end of the plurality of fiber optic strands being visible through the one or more apertures contained on one of the at least two greeting card panels;

a switch which controls illumination of the plurality of fiber optic strands;

a power source which is attached to the switch and which provides power to illuminate the fiber optic bundle via the switch;

wherein pulling the slide panel outside of the open-sided cavity activates the switch thereby causing illumination of the fiber optic strands.

9. The greeting card of claim 8, wherein the slide panel cannot be completely removed from the open-sided cavity.

10. The greeting card of claim 8, wherein the fiber optic strands are aligned with the one or more apertures contained on one of the at least two greeting card panels.

11. The greeting card of claim 8, wherein the at least two greeting card panels each contain a notched portion removed from an open-sided edge of each panel.

12. The greeting card of claim 8, wherein the apertures on one of the at least two greeting card panels are arranged in a decorative pattern.

13. The greeting card of claim 8 further comprising a sound module operative to store and playback at least one audio file.

14. The greeting card of claim 13, wherein playback of the at least one audio file is initiated when the slide panel being removed from the open-sided cavity.

15. The greeting card of claim 8, wherein reinserting the slide panel into the open-sided cavity causes the fiber optic strands to turn off.

16. A greeting card comprising:

a four-sided pocket having one open edge, the four-sided pocket having a front surface and a back surface opposite the front surface, the front surface having a substantial opening contained thereon;

a fabric panel contained within the four-sided pocket and visible through the opening contained on the front surface of the four-sided pocket;

a removable panel which can be substantially inserted into the four-sided pocket and completely removed from the four-sided pocket;

a plurality of fiber optic strands inserted into the fabric panel such that one end of the plurality of fiber optic strands are visible through the substantial opening on the front surface of the four-sided pocket;

a contact switch contained within the four-sided pocket;

a power source connected to the contact switch;

wherein when the removable panel is fully inserted into the four-sided pocket, it extends between two arms of the contact switch and when the removable panel is removed from the four-sided pocket, it is removed from between the two arms of the contact switch, causing the plurality of fiber optic strands to illuminate via the power source.

17. The greeting card of claim 16, wherein the plurality of fiber optic strands are concealed within the four-sided pocket.

18. The greeting card of claim 16, wherein the removable panel contains an opening thereon through which a ribbon is inserted.

19. The greeting card of claim 18, wherein reinserting the removable panel into the four-sided pocket between the two arms of the contact switch causes the fiber optic strands to turn off.

20. The greeting card of claim 16, wherein the removable panel is inserted into the four-sided pocket behind the fabric panel.

* * * * *